US009909247B2

(12) United States Patent
Alexander et al.

(10) Patent No.: US 9,909,247 B2
(45) Date of Patent: Mar. 6, 2018

(54) LAUNDRY TREATING APPLIANCE WITH AN OVERSIZED WASH TUB

(71) Applicant: Whirlpool Corporation, Benton Harbor, MI (US)

(72) Inventors: Benjamin E. Alexander, Stevensville, MI (US); Brent M. Burgess, Edwardsburg, MI (US); Michael K. Cluskey, Saint Joseph, MI (US); Christopher A. Jones, Saint Joseph, MI (US); Aaron A. Linden, Sandwich, IL (US); Dale E. Mueller, Benton Harbor, MI (US); Michele A. Paustian, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 7 days.

(21) Appl. No.: 14/849,958

(22) Filed: Sep. 10, 2015

(65) Prior Publication Data

US 2017/0073872 A1 Mar. 16, 2017

(51) Int. Cl.
*D06F 37/12* (2006.01)
*D06F 37/26* (2006.01)

(52) U.S. Cl.
CPC ..... *D06F 37/262* (2013.01); *D06F 37/12* (2013.01)

(58) Field of Classification Search
CPC ..... D06F 37/12; D06F 37/262
USPC ..... 68/3 R, 23.3, 23 A, 133, 142, 232
See application file for complete search history.

(56) References Cited

U.S. PATENT DOCUMENTS

| | | | | |
|---|---|---|---|---|
| 1,826,030 | A | 10/1931 | Snyder | |
| 2,718,774 | A | 9/1955 | Stephens | |
| 5,965,236 | A * | 10/1999 | Durazzani | B29C 45/00 264/328.1 |
| 9,010,159 | B2 | 4/2015 | Sharp | |
| 2011/0247373 | A1* | 10/2011 | Sharp | D06F 23/04 68/131 |
| 2012/0304703 | A1* | 12/2012 | Kim | D06F 23/04 68/133 |
| 2013/0031938 | A1 | 2/2013 | Cho et al. | |
| 2013/0036776 | A1 | 2/2013 | Seo et al. | |

FOREIGN PATENT DOCUMENTS

| | | |
|---|---|---|
| GB | 625326 | 6/1949 |

* cited by examiner

*Primary Examiner* — Levon J Shahinian

(57) ABSTRACT

A laundry treating appliance for treating fabric according to a cycle of operation includes a cabinet defining an interior, a wash tub within the interior and having a peripheral wall with an upper portion and a bottom end closed by a base; a wash basket located within the wash tub for movement relative thereto and defining a laundry treating chamber; and a drive motor located within the cabinet for rotating or oscillating the wash basket. Prior to installation of the wash tub in the cabinet, the wash tub is oversized relative to the interior. After installation of the wash tub in the cabinet, the upper portion of the wash tub forms a press fit with the cabinet such that the upper portion of the wash tub exerts a force on the cabinet.

6 Claims, 8 Drawing Sheets

LAUNDRY TREATING APPLIANCE WITH AN OVERSIZED WASH TUB

BACKGROUND OF THE INVENTION

Laundry treating appliances, such as vertical axis laundry treating appliances, typically include a cabinet, a wash tub in the interior of the cabinet, and a rotatable wash basket mounted in the wash tub that receives laundry for treatment according to a cycle of operation. Supported by one or more suspension systems, the wash tub can suspend from the cabinet. Both the wash basket and wash tub typically have an upper opening at their respective upper ends.

During the operation of the vertical laundry treating appliance with the suspended wash tub, the laundry load is limited by the wash basket size that, in turn, is limited by the suspended wash tub size. To increase the capacity of a vertical axis laundry treating appliance, prior solutions have focused on statically fixing the wash tub or eliminating the wash tub and modifying the wash basket to be imperforate or to have multiple walls.

BRIEF DESCRIPTION

In one aspect, a laundry treating appliance for treating fabric according to a cycle of operation includes a cabinet defining an interior; a wash tub within the interior and having a peripheral wall with an upper portion and a bottom end closed by a base wherein the wash tub is oversized relative to the interior such that at least one first dimension of the upper portion of the wash tub is larger than at least one second dimension of the interior prior to installation of the wash tub in the cabinet; wash basket located within the wash tub for movement relative thereto and defining a laundry treating chamber; and a drive motor located within the cabinet for rotating or oscillating the wash basket. The upper portion of the wash tub is press fit within the cabinet at the at least one first dimension and the at least one second dimension after installation of the wash tub in the cabinet.

In another aspect, a method of assembling a laundry treating appliance for treating laundry according to an automatic cycle of operation includes providing a cabinet that defines an interior; forming a wash tub having a peripheral wall closed at its bottom end and an upper portion oversized relative to the cabinet; and inserting the wash tub into the cabinet such that the upper portion is press fit within the interior.

In another aspect, a wash tub for a laundry treating appliance for treating fabric according to a cycle of operation includes a peripheral wall with an upper portion having at least one first dimension larger than at least one second dimension of a cabinet of a laundry treating appliance and a base at a bottom end of the peripheral wall to close the bottom of the wash tub. Upon insertion of the wash tub into the cabinet, the upper portion of the peripheral wall of the wash tub is press fit within the cabinet at the at least one first dimension and the at least one second dimension

DETAILED DESCRIPTION

Typically, a vertical axis laundry treating appliance having a wash tub suspended from a cabinet, and a rotatable wash basket disposed in the wash tub, can have multiple performance limitations. For example, the size of the wash basket and corresponding capacity of laundry load can be limited by the position of the suspended wash tub in the vicinity of the rotatable wash basket and one or more suspension systems exterior of the suspended wash tub in the cabinet. Previously mentioned alternatives for increasing capacity (e.g. statically affixing the wash tub to the cabinet or eliminating the wash tub altogether and modifying the wash basket to have imperforate or multiple walls) are known to require retention of water inside of the wash basket for washing clothes and the retention of water in a sump area which leads to a complex design due to leakage issues, water sensing, and water heating. Additionally, the fixed wash tub concept can include subjecting many functioning components such as elements of the suspension system to a corrosive environment of wash water.

Figure 1:
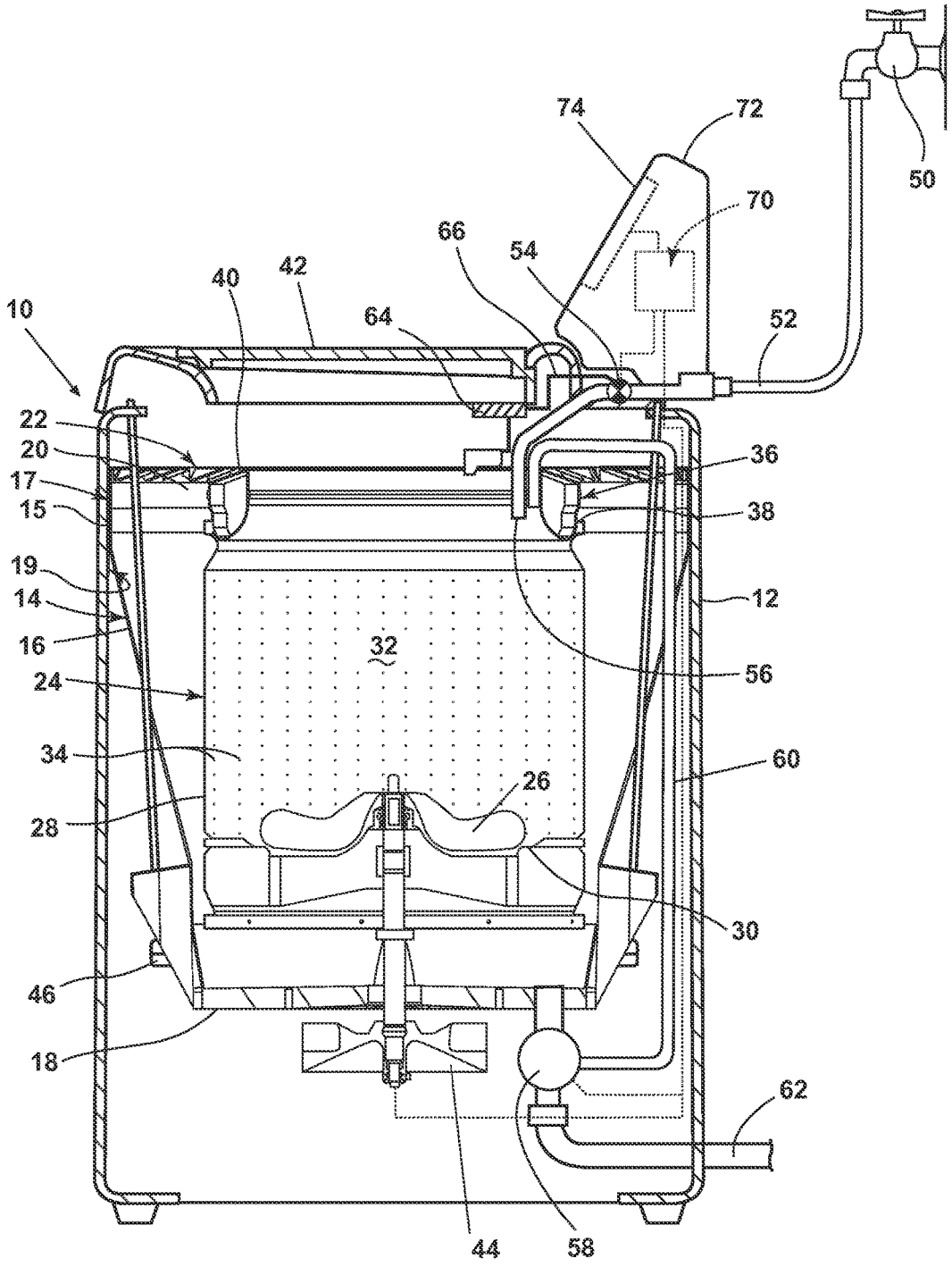
FIG. 1 is a schematic cross-sectional view of a laundry treating appliance with an oversized wash tub.

Referring now to the drawings, FIG. 1 is a schematic view of an exemplary laundry treating appliance 10 in the form of a laundry treating appliance according to an embodiment. While the laundry treating appliance 10 is illustrated as a vertical axis, top-fill laundry treating appliance, other relevant laundry treating appliances include, but are not limited to, a horizontal axis laundry treating appliance, a combination laundry treating appliance including a washer and dryer, an extractor, a non-aqueous laundry treating appliance, and a tumbling or stationary refreshing/revitalizing machine.

The laundry treating appliance of FIG. 1 is illustrated as a vertical axis laundry treating appliance 10, which can include a structural support system comprising a cabinet 12 within which a laundry holding system resides. The cabinet 12 can be a housing having a chassis and/or a frame, and defines an interior for receiving components typically found in a conventional laundry treating appliance, such as motors, pumps, fluid lines, controls, sensors, transducers, and the like. Such components will not be described further herein except as necessary for a complete understanding of the invention. It will be understood that the terms "vertical" and "horizontal" are provided with respect to earth's gravity. For example, the vertical axis is parallel to the force of gravity whereas a horizontal axis is normal to the force of gravity.

The laundry holding system of the illustrated exemplary laundry treating appliance 10 can include a wash tub 14 installed in the interior defined by the cabinet 12. The wash tub 14 can have a peripheral wall 16 closed at its bottom end by a base 18. An upper edge 20 of the peripheral wall 16 can define an opening to an interior of the wash tub 14 for holding liquid, and a wash tub ring 22 can be mounted to the wash tub 14 at or near the upper edge 20.

The wash tub 14 is in physical contact with the cabinet 12 via a bearing interface 15. In exemplary implementations, the bearing interface 15 allows vertical translation of the wash tub 14 with respect to the cabinet 12, which is beneficial because it allows for proper functioning of a suspension system 46. For example, in one implementation, the bearing interface 15 can allow for a total vertical travel of the wash tub 14 of about 75 millimeters. Other ranges for the total vertical travel are contemplated and can be based upon design requirements of elements of the suspension system 46 such as suspension springs.

In such implementations, the bearing interface 15 can be any interface between the wash tub 14 and the cabinet 12 that restricts or prevents rotation of the wash tub 14 with respect to the cabinet while allowing vertical translation. In one non-limiting example, the bearing interface 15 can be frictional physical contact between the upper portion 17 of the wash tub 14 and the cabinet 12. In another non-limiting example, the bearing interface 15 can include an intervening material between the upper portion 17 of the wash tub 14 and the cabinet 12 having features that allow vertical translation and limit rotation of the wash tub 14 with respect to the cabinet 12. The intervening material can be any suitable material disposed between the cabinet and the tub including but not limited to a liner, foam padding, etc. The bearing interface 15 or the interior surface 19 of the cabinet 12 or the upper portion 17 of wash tub 14 can include, alone or in combination, any suitable additional structural features for controlling the fit between the wash tub 14 and the cabinet. For example, any of the intervening material, the interior surface 19 of the cabinet 12 and the upper portion 17 of wash tub 14 can be formed with a set of vertical ribs.

At the bearing interface 15, the upper portion 17 of the wash tub 14 forms a press fit with the cabinet 12 such that the upper portion 17 of the wash tub 14 presses up against an interior surface 19 of the cabinet 12, exerting a force on the cabinet 12 that holds the wash tub 14 in place relative to the cabinet 12, so as to prevent rotational movement of the tub relative to the cabinet 12, but still allow limited vertical movement of the tub relative to the cabinet. A press fit, also known as an interference fit or friction fit, is a fastening between two parts which is achieved by friction after one of the parts is forced, under pressure, into an opening in the second part. The upper portion 17 of the wash tub 14 is part of the peripheral wall 16, which is in contact with the cabinet 12 via the bearing interface 15. The walls of the cabinet 12 deform the upper portion 17 of the wash tub 14 at the bearing interface 15. In one exemplary implementation, the resulting deformed configuration of the upper portion 17 of the wash tub 14 has a horizontal cross-section resembling a rectangle with rounded corners.

A rotating laundry-container is illustrated in the form of a perforated wash basket 24, which can be mounted in the wash tub 14 for rotation about an axis of rotation, such as, for example, a central, vertical axis extending through the center of a laundry mover 26 in the form of an impeller, as an example, located within the wash basket 24. Other exemplary types of laundry movers include, but are not limited to, an agitator, a wobble plate, and a hybrid impeller/agitator. The wash basket 24 can have a peripheral wall 28 closed at its bottom end by a base 30 to form an interior at least partially defining a laundry treating chamber 32 receiving a load of laundry items for treatment. The peripheral wall 28 can include a plurality of perforations or apertures 34 such that liquid supplied to the wash basket 24 can flow through the perforations 34 to the wash tub 14. A balance ring 36 can be coupled with an upper edge 38 of the wash basket peripheral wall 28 to counterbalance a load imbalance that can occur within the treating chamber 32 during a cycle of operation. While the laundry treating appliance 10 can employ any type of balance ring 36, an exemplary balance ring is disclosed in U.S. Pat. No. 9,010,159, issued Apr. 21, 2015, whose disclosure is incorporated by reference in its entirety. The illustrated balance ring 36 can include a chamfered or inclined top wall 40 on an upper portion of the balance ring 36. The chamfer or incline of the top wall 40 can be approximately 35 degrees from a horizontal plane. As illustrated, the entire top wall 40 is inclined, but it is contemplated that alternatively only a portion of the top wall 40 is inclined relative to the horizontal, as shown and described in the aforementioned and incorporated '159 publication. The top of the cabinet 12 can include a selectively openable lid 42 to provide access into the laundry treating chamber 32 through an open top of the wash basket 24.

A drive system including a drive motor 44, which can include a gear case, can be utilized to rotate the wash basket 24 and the laundry mover 26. The motor 44 can rotate the wash basket 24 at various speeds, including at a spin speed wherein a centrifugal force at the inner surface of the wash basket peripheral wall 28 is 1 g or greater; spin speeds are commonly known for use in extracting liquid from the laundry items in the wash basket 24, such as after a wash or rinse step in a treating cycle of operation. The motor 44 can also oscillate or rotate the laundry mover 26 about its axis of rotation during a cycle of operation in order to provide movement to the load contained within the laundry treating chamber 32. The illustrated drive system for the wash basket 24 and the laundry mover 26 is provided for exemplary purposes only and is not limited to that shown in the drawings and described above.

In addition to the press fit between the peripheral wall 16 of the wash tub 14 and the cabinet 12 at the bearing interface 15, a suspension system 46 can dynamically support the wash tub 14 within the cabinet 12. The suspension system 46 can dissipate a determined degree of vibratory energy generated by the rotation of the wash basket 24 and/or the laundry mover 26 during a treating cycle of operation. Together, the wash tub 14, the wash basket 24, and any contents of the wash basket 24, such as liquid and laundry items, define a suspended mass for the suspension system 46. The suspension system 46 can be any type of suspension system including but not limited to a system having a plurality of rods coupling the exterior of the base 18 of the wash tub 14 to an upper part of the cabinet or a plurality of spring and damper elements connecting the wash tub 14 to a base of the cabinet.

The laundry treating appliance 10 can be fluidly connected to a liquid supply 50 through a liquid supply system including a liquid supply conduit 52 having a valve assembly 54 that can be operated to selectively deliver liquid, such as water, to the wash tub 14 through a liquid supply outlet 56, which is shown by example as being positioned at one side of the wash tub 14. The laundry treating appliance 10 can further include a recirculation and drain system having a pump assembly 58 that can pump liquid from the wash tub 14 back into the wash tub 14 through a recirculation conduit 60 for recirculation of the liquid and/or to a drain conduit 62 to drain the liquid from the machine 10. The illustrated liquid supply system and recirculation and drain system for the laundry treating appliance 10 are provided for exemplary purposes only and are not limited to those shown in the drawings and described above.

The laundry treating appliance 10 can also be provided with a dispensing system for dispensing treating chemistry to the wash basket 24, either directly or mixed with water from the liquid supply system, for use in treating the laundry according to a cycle of operation. The dispensing system can include a dispenser 64 which can be a single use dispenser, a bulk dispenser, or a combination of a single use and bulk dispenser. Water can be supplied to the dispenser 64 from the liquid supply conduit 52 by directing the valve assembly 54 to direct the flow of water to the dispenser 64 through a dispensing supply conduit 66.

The laundry treating appliance 10 can also be provided with a heating system (not shown) to heat liquid provided to the treating chamber 32. In one example, the heating system can include a heating element provided in the base 18 to heat liquid that collects therein. Alternatively, the heating system can be in the form of an in-line heater that heats the liquid as it flows through the liquid supply, dispensing, and/or recirculation systems.

The liquid supply, dispensing, and recirculation and drain systems can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry. For example, the liquid supply system and/or the dispensing system can be configured to supply liquid into the interior of the wash tub 14 not occupied by the wash basket 24 such that liquid can be supplied directly to the wash tub 14 without having to travel through the wash basket 24.

The laundry treating appliance 10 can further include a control system for controlling the operation of the laundry treating appliance 10 to implement one or more treating cycles of operation. The control system can include a controller 70 located within a console 72 or elsewhere, such as within the cabinet 12, and a user interface 74 that is operably coupled with the controller 70. The user interface 74 can include one or more knobs, dials, switches, displays, touch screens, and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
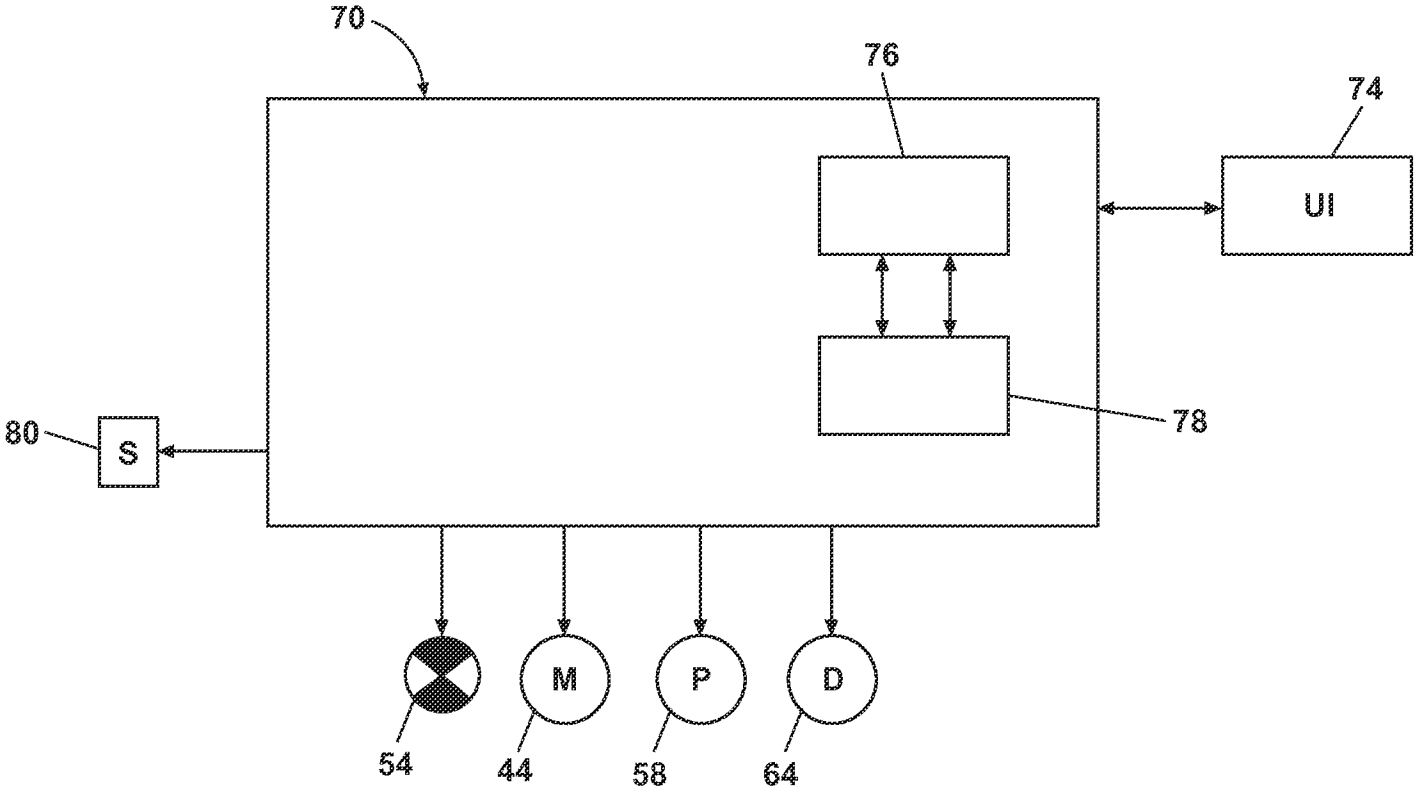
FIG. 2 is a schematic view of a controller of the laundry treating appliance of FIG. 1.

As illustrated in FIG. 2, the controller 70 can include a memory 76 and a central processing unit (CPU) 78. The memory 76 can be used for storing the control software that is executed by the CPU 78 in completing a treating cycle of operation using the laundry treating appliance 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the laundry treating appliance 10 that can be communicably coupled with the controller 70. The database or table can be used to store the various operating parameters for the one or more cycles of operation, including factory default values for the operating parameters and any adjustments to them by the control system or by user input. Such information or operating parameters stored in the memory 76 can also include acceleration ramps, threshold values, predetermined criteria, etc.

The controller 70 can be operably coupled with one or more components of the laundry treating appliance 10 for communicating with and controlling the operation of the component to complete a cycle of operation. For example, the controller 70 can be operably coupled with the motor 44, the valve assembly 54, the pump assembly 58, the dispenser 64, and any other additional components that can be present such as a steam generator and/or a heater (not shown) to control the operation of these and other components to implement one or more of the cycles of operation. The controller 70 can also be coupled with one or more sensors 80 provided in one or more of the systems of the laundry treating appliance 10 to receive input from the sensors, which are known in the art and not shown for simplicity. Such sensors 80 can include a motor torque sensor, a speed sensor, an acceleration sensor, and/or a position sensor providing an output or signal indicative of the torque applied by the motor 44, a speed of the wash basket 24 or component of the drive system, an acceleration of the wash basket 24 or component of the drive system, and a position sensor of the wash basket 24.

Figure 3:
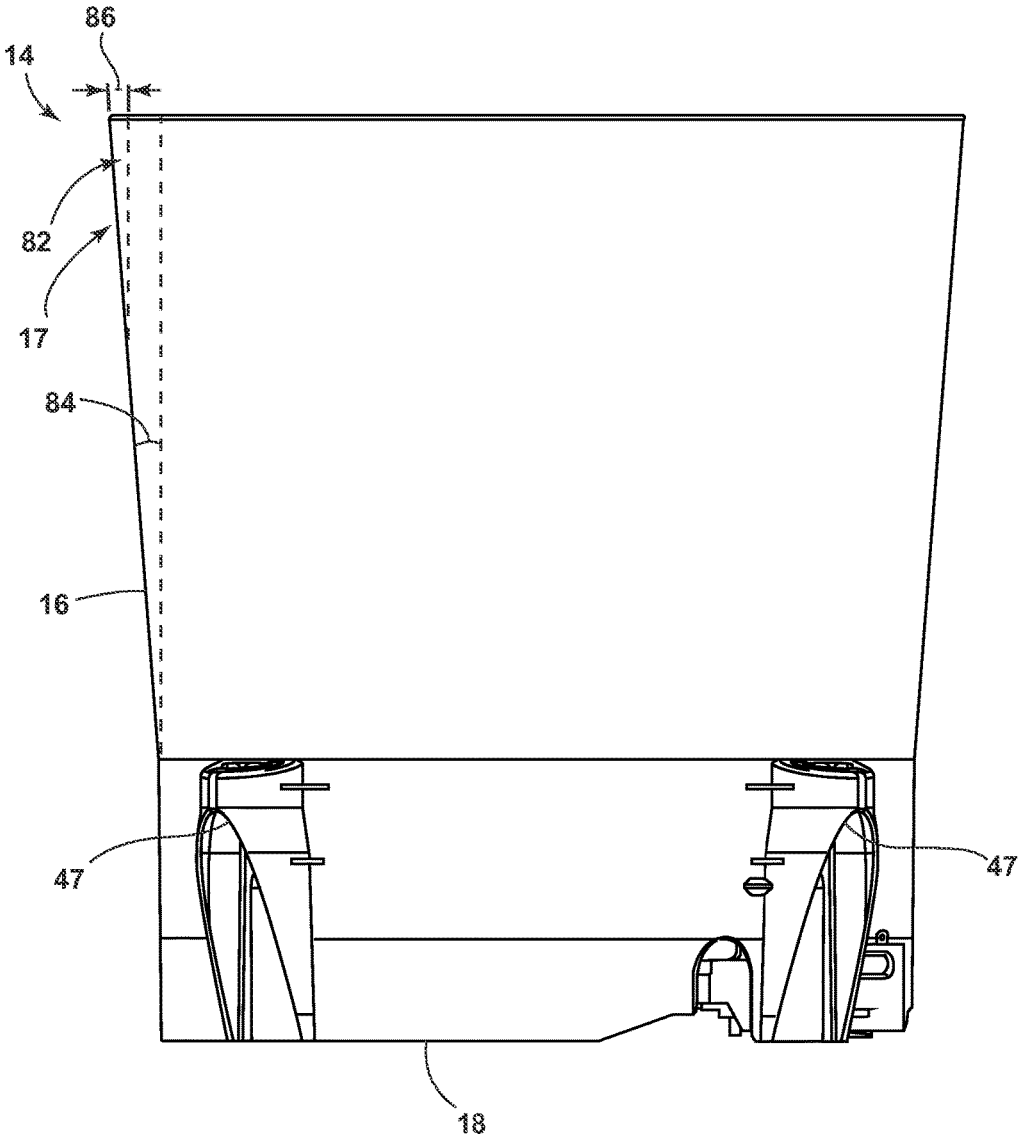
FIG. 3 is a side view of an oversized wash tub.

FIG. 3 is a side view of the oversized wash tub 14 of FIG. 1 prior to installation into the cabinet of a laundry treating appliance. The wash tub 14 includes the peripheral wall 16 closed at its bottom by the base 18. Additionally, the base 18 can include other components related to laundry functions and cycles of operations including, but not limited to suspension mounts 47.

The oversized wash tub 14 can be initially formed into any shape and size suitable for a press fit into the cabinet of a laundry treating appliance. In one exemplary implementation, as shown in FIG. 3, the peripheral wall 16 of the wash tub 14 is initially formed into the shape of a conical frustum. In another exemplary implementation described in FIG. 5 below, the peripheral wall 16 of the wash tub 14 is initially formed into the shape of a cylinder.

As a conical frustum, the peripheral wall 16 of the wash tub 14 can include a horizontal cross-section that is circular from top to bottom where the radii of the circular cross-sections decreases from a maximum radius at the top of the wash tub 14 to a minimum radius where the peripheral wall 16 meets the base 18. The angle 84 formed by the peripheral wall 16 relative to a straight line vertical to the bottom 18 can be any suitable angle for increasing capacity in the wash tub and providing a surface 82 for pressing against an interior surface of the cabinet upon installation, including, but not limited to 1 to 15 degrees.

The wash tub 14 is molded with any suitable manufacturing process including, but not limited to injection molding, thermoforming, rotational molding, blow molding, gas-assist molding, structural-foam molding, reaction-injection molding, coinjection, etc. The wash tub 14 can be molded from any suitable material including, but not limited to, acrylonitrile styrene (ABS), polypropylene (PP), ethylene propylene diene monomer (EPDM) rubber, calcium carbonate, fiberglass and combinations thereof.

Prior to installation, the wash tub 14 can include an upper portion 17 that is oversized relative to the cabinet of the laundry treating appliance. The upper portion 17 of the peripheral wall 16 defines a set of circular cross-sections where the diameters of the set of horizontal cross-sections of the peripheral wall 16 are greater than the length of the side of the rectangular horizontal cross-section of the cabinet. Therefore, upon insertion of the wash tub 14 into the cabinet, the upper portion 17 of the peripheral wall 16 of the wash tub 14 deforms to a configuration having a second horizontal cross-section where the excess length 86 of the diameter of the upper portion 17 of the peripheral wall 16 with respect to the horizontal length of the cabinet is compressed.

Figure 4:
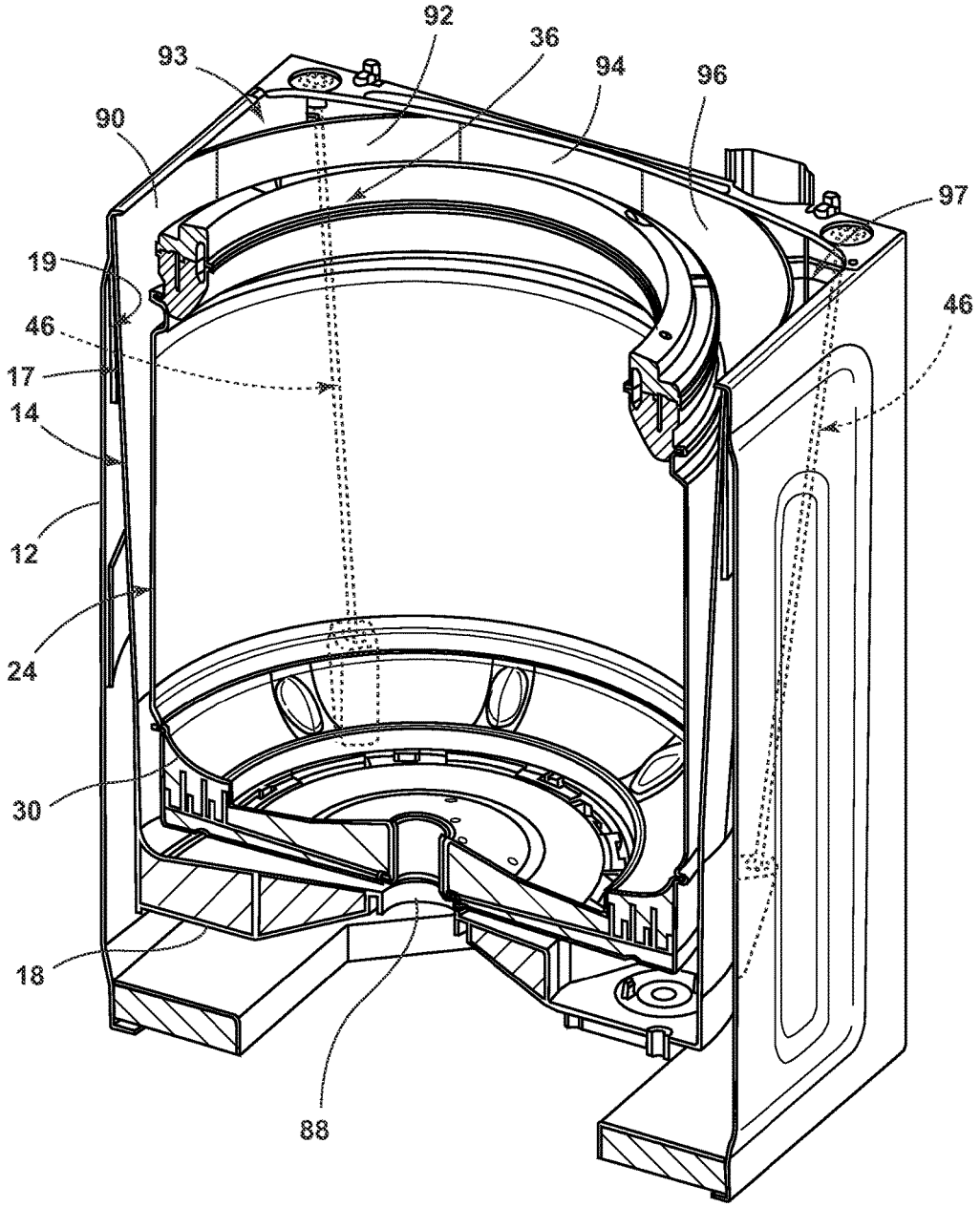
FIG. 4 is a perspective cross-sectional view of a laundry treating appliance with the oversized wash tub of FIG. 3.

Referring now to FIG. 4, a perspective cross-sectional view of a laundry treating appliance with an oversized wash tub 14 installed within the cabinet 12 is shown. Upon relaxation, the deformed upper portion 17 of the peripheral wall 16 of the wash tub 14 can press against and exert a force on the interior surface 19 of the cabinet 12 to form a press fit. That is, the wash tub 14 is forced into the cabinet 12 until the upper portion 17 of the wash tub 14 contacts the sides of the cabinet 12, flattening the upper portion 17 of the wash tub 14. In one exemplary implementation, the upper portion 17 of the wash tub 14, initially formed as a tapered conical frustum, deforms into a configuration with a horizontal cross-section of rectangle with rounded corners. In the deformed configuration, the upper portion 17 of the peripheral wall 16 can contact the cabinet 12 at the flattened surfaces 90, 94 of the peripheral wall 16.

The rounded corners 92, 96 of the upper portion 17 of the peripheral wall provide area 93, 97 for additional elements of the laundry treating appliance without encroaching the interior of the wash tub 14 or the wash basket 24. The additional elements can be any element suitable for placement in the corners of the cabinet 12 including but not limited to the suspension elements 46.

Upon installation of the wash tub 14 into the cabinet 12, the wash basket 24 can be provided within the wash tub 14. Alignment of the wash basket 24 within the wash tub 14 can include axial alignment of the wash basket base 30 to the wash tub base 18 for ready assembly of a drive shaft of a motor through the center portions 88 of the bases 18, 30, so as to enable rotation of the wash basket 24 during a cycle of operation.

Figure 5:
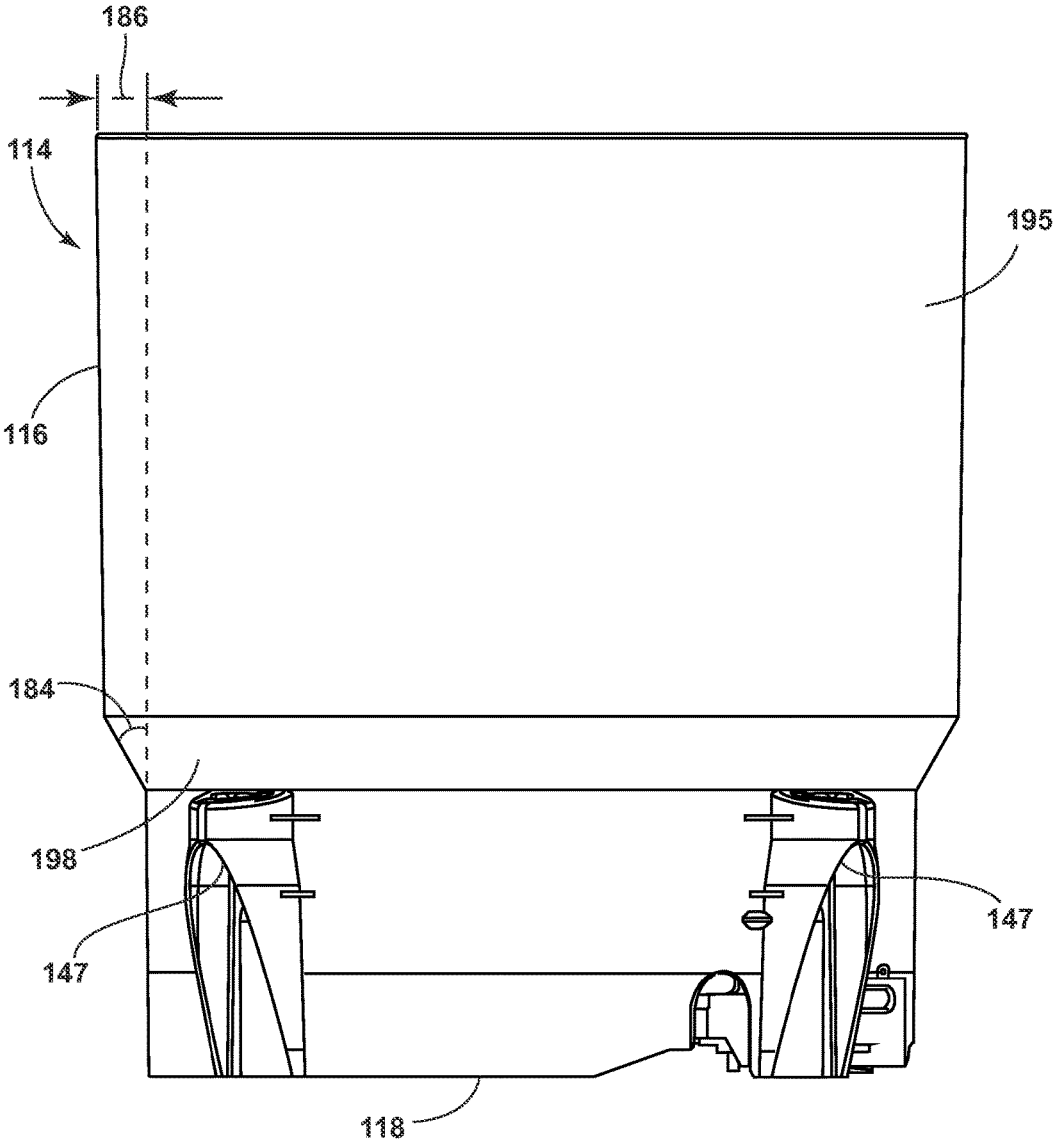
FIG. 5 is a side view of an oversized wash tub.

FIG. 5 illustrates an alternative oversized wash tub 114. The oversized wash tub 114 is similar to that illustrated in FIG. 3; therefore, like parts will be identified with like numerals increased by 100, with it being understood that the description of the like parts of the first oversized wash tub applies to the second oversized wash, unless otherwise noted. Again, the figures of the second oversized wash tub 114 are intended to illustrate one non-limiting example of the oversized wash tub, as described, and do not specifically represent any necessary feature or shape of the wash tub or its method of assembly into a laundry treating appliance.

Prior to installation into a cabinet of a laundry treating appliance, the wash tub 114 is initially formed as an integrally molded cylinder 195 and a base 118 with a conical frustum 198 therebetween. The angle 184 formed by the conical frustum 198 relative to a straight line vertical to the bottom 118 can be any suitable angle for increasing capacity in the wash tub including, but not limited to, 20 to 45 degrees with a nominal range of 25 to 30 degrees.

The oversized upper portion 117 of the wash tub 114 includes the peripheral wall 116 and an upper portion of the conical frustum 198 where the wash tub 114 is to form a press fit with the cabinet. Upon insertion of the wash tub 114 into the cabinet, the peripheral wall 116 of the wash tub 114 deforms to a configuration with a cross-section where some length less than the excess length 186 of the diameter of the upper portion 117 of the peripheral wall 116 is compressed to form a press fit along the vertical entirety of the formerly cylindrical upper portion of the peripheral wall 116 and an upper portion of the conical frustum 198. In one exemplary implementation, the horizontal cross-section is a rectangle with rounded corners.

Figure 6:
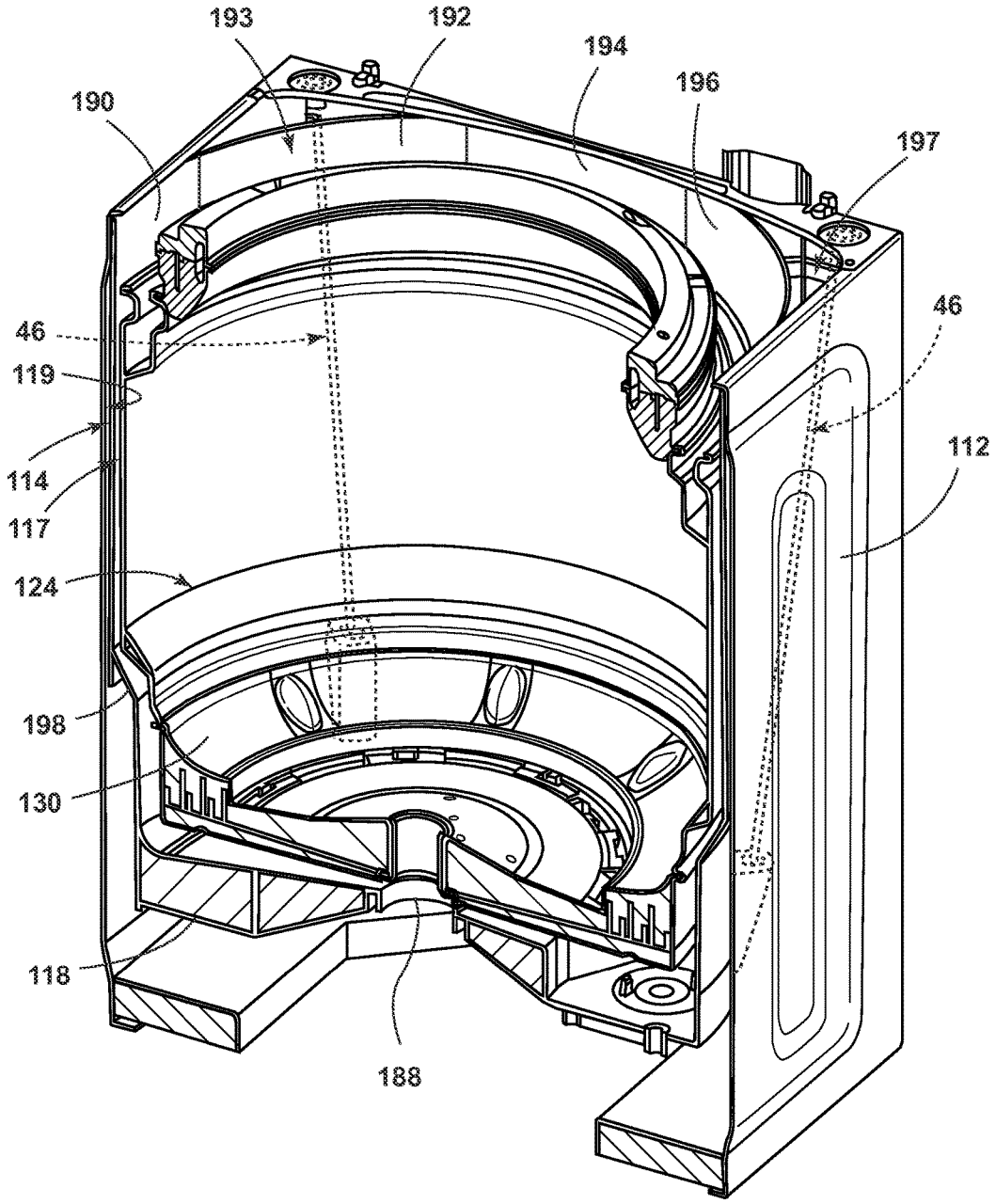
FIG. 6 is a perspective cross-sectional view of a laundry treating appliance with the oversized wash tub of FIG. 5.

Referring now to FIG. 6, a perspective cross-sectional view of a laundry treating appliance with an oversized wash tub 114 installed within the cabinet 112. The flattened surfaces 190, 194 extend down the entirety of the peripheral wall 116. The geometry of the wash basket 124 can track the wash tub 114 and can include a cylindrical upper portion transitioning to a circular base 130 with an intermediate tapered region similar to that of the conical frustum 198 of the wash tub 114, though other configurations can be implemented.

Figure 7B:
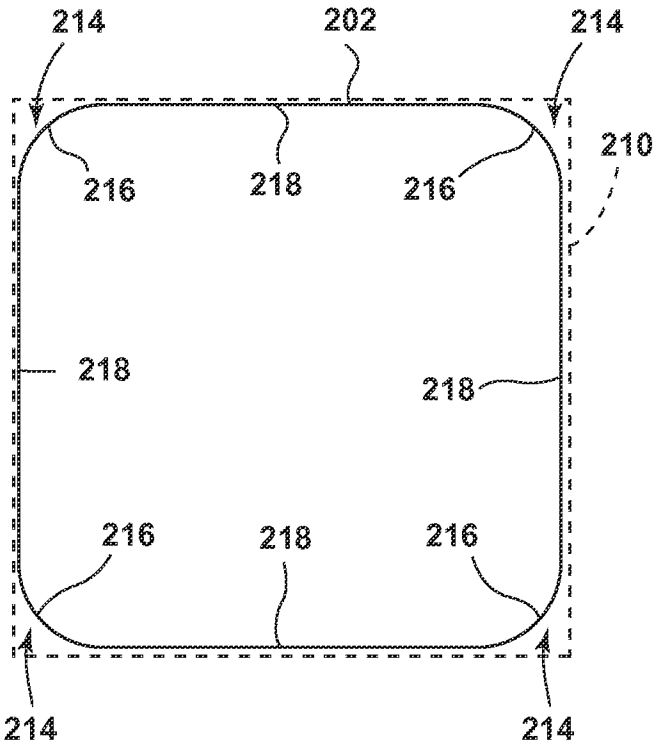
FIG. 7B is a horizontal cross-sectional view of the upper part of the oversized wash tub in a deformed configuration after installation in the cabinet of a laundry treating appliance.
Figure 7A:
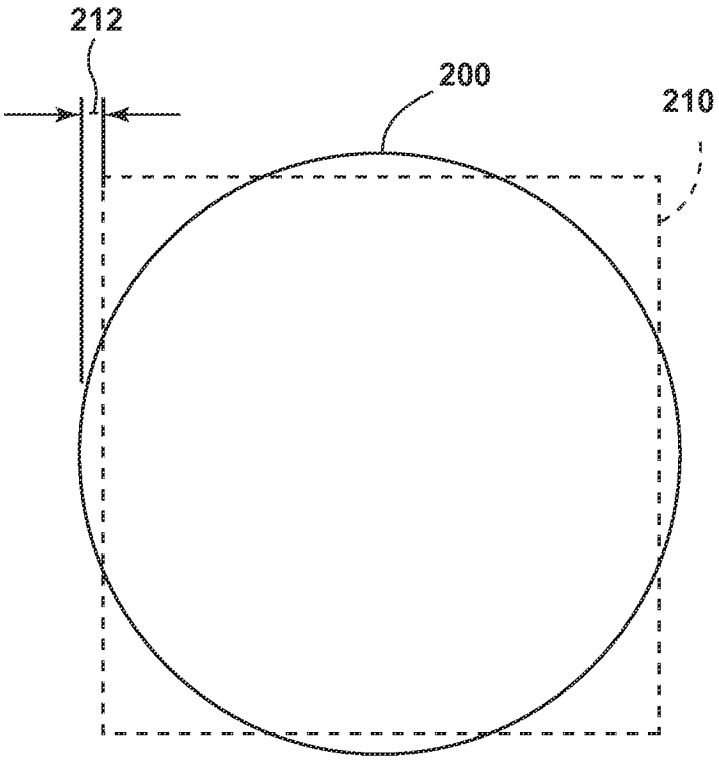
FIG. 7A is horizontal cross-sectional view of the upper part of the oversized wash tub in a normal configuration prior to installation in the cabinet of a laundry treating appliance.

Referring now to FIG. 7A, a horizontal cross-sectional view of the upper part of the oversized wash tub 200 in a normal configuration prior to installation in the cabinet 210 of a laundry treating appliance is shown. The horizontal cross-section of wash tub 200 resembles a circle with a diameter that is longer than the length of the corresponding cross-section of the interior of the cabinet 210 that resembles a rectangle. The extra length 212 of the diameter of horizontal cross-section of wash tub 200 with respect to the length of the corresponding rectangular cross-section of the interior of the cabinet 210 forms the interference or overlap used for the press fit between the wash tub 200 and the cabinet 210.

Referring now to FIG. 7B, a horizontal cross-sectional view of the upper part of the oversized wash tub 202 in a deformed configuration subsequent to installation in the cabinet 210 of a laundry treating appliance is shown. Forcing the wash tub 202 into the cabinet 210 to form a press fit results in the wash tub assuming a deformed configuration. The horizontal cross-section of wash tub 202 resembles a rectangle with rounded corners confined by the corresponding rectangular cross-section of the interior of the cabinet 210. The sides 218 of the rectangular wash tub 202 press against the interior of the cabinet 210. The rounded edges 216 of the wash tub 202 expose pockets 214 between the corners of the cabinet 210 and the wash tub 202. While shown with a cross-section resembling a rectangle with rounded corners, the wash tub 202 can include other configurations suitable for a press fit connection with the cabinet such as sides 218 that bow inwards or are buckled depending on how the wash tub 202 is inserted into the cabinet 210. Other relevant factors to that will determine the deformed configuration of the wash tub include the relative dimensions of the wash tub to the cabinet, etc. It will be apparent that where the horizontal cross section of the upper portion of the wash tub is non circular after press fit within the cabinet, the shape thereof itself will inhibit rotational movement of the wash tub relative to the cabinet.

Figure 8B:
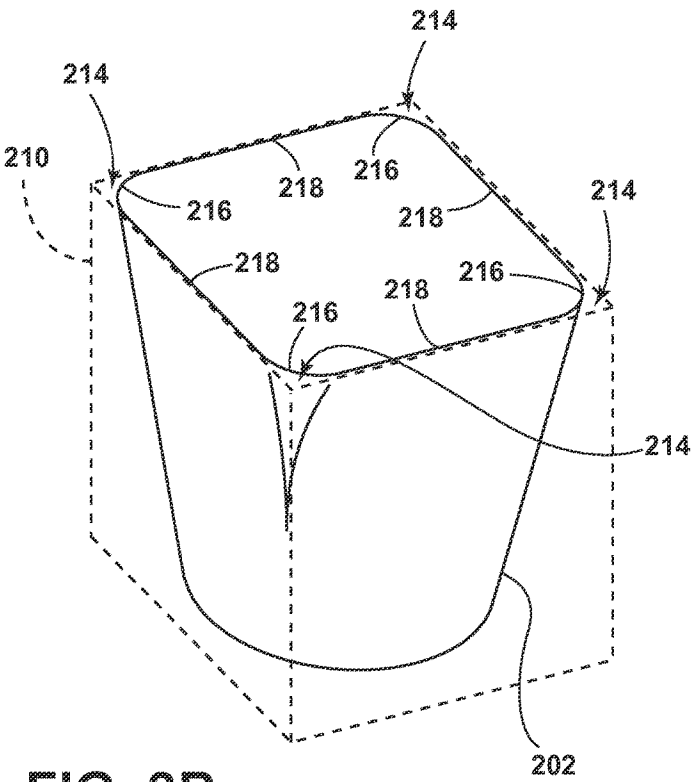
FIG. 8B is a perspective view of the oversized wash tub in a deformed configuration after installation in the cabinet of a laundry treating appliance.
Figure 8A:
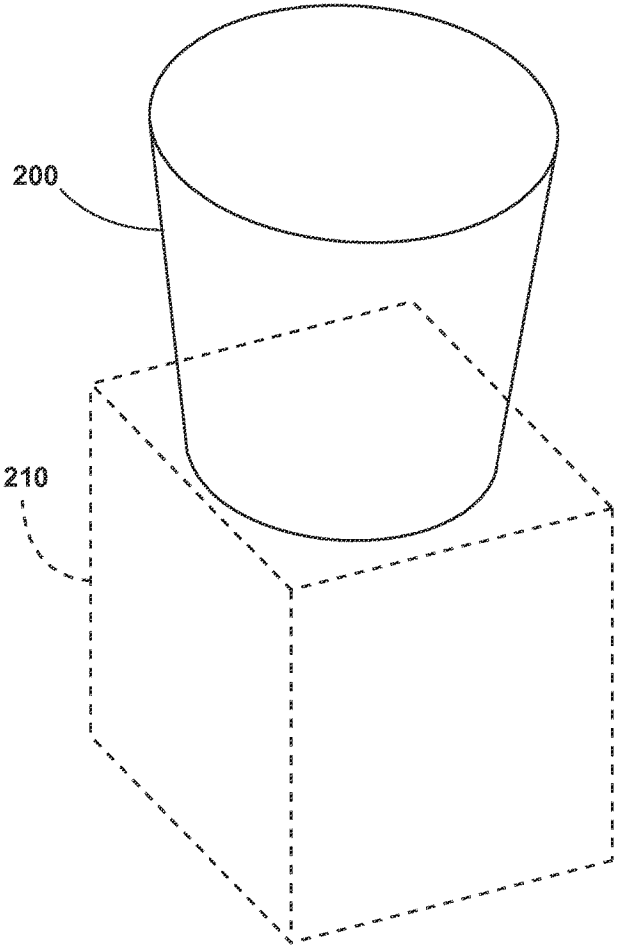
FIG. 8A is a perspective view of the oversized wash tub in a normal configuration prior to installation in the cabinet of a laundry treating appliance.

FIG. 8A is a perspective view of the oversized wash tub 200 in a normal configuration prior to installation in the cabinet 210 of a laundry treating appliance. FIG. 8B is a perspective view of the oversized wash tub 202 in a deformed configuration after installation in the cabinet 210 of a laundry treating appliance.

The above-described embodiments describe a press fit connection between an oversized wash tub and the cabinet of a laundry treating appliance. It is to be understood that the press fit connection can include one or more intervening structures such that the press fit occurs between an upper portion of the wash tub and the intervening structure rather than directly against interior surface of the cabinet. Intervening structures can be any structure suitable for placement between the cabinet and the wash tub, including, but not limited to a liner and foam padding. Also, it is to be understood that the interior surface of the cabinet might not be smooth, but include irregular portions whereby the wash tub might not press up against those irregular portions. For example, if the cabinet includes a portion that juts outwardly, the wash tub will not form fit into the jutted portion.

The above-described embodiments provide a variety of benefits including increased capacity for a laundry treating appliance with a standard dimensioned cabinet. The press fit between the oversized wash tub and the cabinet enables increased capacity and mitigates deleterious vibrational effects by allowing vertical translation of the wash tub during a cycle of operation. Furthermore, the above-described embodiments do not expose elements of the suspension system to a corrosive environment of wash water.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. The primary differences between the exemplary embodiments relate to the shape and form factor of the oversized wash tub relative to the cabinet. These features may be combined in any suitable manner to modify the above embodiments and create new embodiments.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating fabric according to a cycle of operation, comprising:

a cabinet defining an interior;

a wash tub within the interior and having a peripheral wall with an upper portion and a bottom end closed by a base, wherein the wash tub is oversized relative to the interior such that at least one first dimension of the upper portion of the wash tub is larger than at least one second dimension of the interior prior to installation of the wash tub in the cabinet;

a wash basket located within the wash tub for movement relative thereto and defining a laundry treating chamber; and a drive motor located within the cabinet for rotating or oscillating the wash basket;

wherein the upper portion of the wash tub is press fit within the cabinet at the at least one first dimension and the at least one second dimension after installation of the wash tub in the cabinet.

2. The laundry treating appliance of claim 1 wherein the press fit includes a bearing interface that allows vertical translation of the wash tub with respect to the cabinet during the cycle of operation.

3. The laundry treating appliance of claim 2 wherein the bearing interface allows vertical translation ranging from 20 millimeters to 75 millimeters.

4. The laundry treating appliance of claim 1 further including a liner or a foam pad disposed between the cabinet and the wash tub.

5. The laundry treating appliance of claim 1 further including a plurality of suspension rods coupling the base of the wash tub to an upper portion of the cabinet.

6. The laundry treating appliance of claim 1 wherein the wash tub is made from acrylonitrile styrene or polypropylene.

* * * * *